US008978207B2

(12) United States Patent
Sutrina

(10) Patent No.: US 8,978,207 B2
(45) Date of Patent: Mar. 17, 2015

(54) VACUUM CLEANER EDGE CLEANING SYSTEM

(71) Applicant: Electrolux Home Care Products, Inc., Charlotte, NC (US)

(72) Inventor: Thomas Sutrina, Charlotte, NC (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 174 days.

(21) Appl. No.: 13/834,143

(22) Filed: Mar. 15, 2013

(65) Prior Publication Data

US 2014/0259520 A1 Sep. 18, 2014

(51) Int. Cl.
*A47L 5/28* (2006.01)
*A47L 9/06* (2006.01)

(52) U.S. Cl.
CPC . *A47L 5/28* (2013.01); *A47L 9/0686* (2013.01)
USPC ..... 16/334; 15/335; 15/416

(58) Field of Classification Search
CPC ..... A47L 5/28; A47L 5/225
USPC ..... 15/331–335, 416
IPC ..... A47L 5/32, 5/36, 9/00
See application file for complete search history.

(56) References Cited

U.S. PATENT DOCUMENTS

| | | | |
|---|---|---|---|
| 1,726,592 | A | 9/1929 | Spanel |
| 3,205,528 | A | 9/1965 | Fromknecht et al. |
| 3,879,797 | A | 4/1975 | Principe et al. |
| 3,936,903 | A | 2/1976 | Johnson |
| 3,942,216 | A | 3/1976 | Minton |
| 3,942,219 | A | 3/1976 | Johnson |
| 4,023,234 | A | 5/1977 | Martinec et al. |
| 4,959,885 | A | 10/1990 | Sovis et al. |
| 5,189,757 | A | 3/1993 | Williams et al. |
| 5,347,678 | A | 9/1994 | Williams et al. |
| 5,355,549 | A | 10/1994 | Steinberg et al. |
| 5,398,373 | A | 3/1995 | Blasé et al. |
| 5,477,586 | A | 12/1995 | Jacobs et al. |
| 5,513,418 | A | 5/1996 | Weber |
| 5,867,861 | A | 2/1999 | Kasen et al. |
| 6,006,402 | A | 12/1999 | Maurer et al. |
| 6,039,817 | A | 3/2000 | Payne |

(Continued)

FOREIGN PATENT DOCUMENTS

| | | |
|---|---|---|
| EP | 1671570 | 6/2006 |
| GB | 2378643 | 2/2003 |
| JP | H0549563 | 3/1993 |

OTHER PUBLICATIONS

International Search Report and Written Opinion for PCT International Application No. PCT/US2014/025802 dated Aug. 7, 2014.

*Primary Examiner* — David Redding
(74) *Attorney, Agent, or Firm* — RatnerPrestia

(57) ABSTRACT

A vacuum cleaner having a based and a handle. The handle has first and second valves to selectively receive suction airflow from a main suction inlet, a first edge cleaning inlet, and an accessory hose. The first valve is operable to connect a dirt separator to either a main floor cleaning inlet or an auxiliary cleaning inlet. The second valve is operable to selectively connect the auxiliary cleaning inlet to the edge cleaning inlet. The accessory hose is mountable to an accessory hose mount on the handle. When mounted, the accessory hose contacts a second actuator for the second valve to hold the second valve in an edge cleaning position.

24 Claims, 9 Drawing Sheets

(56) References Cited

U.S. PATENT DOCUMENTS

| | | | |
|---|---|---|---|
| 6,237,189 | B1 | 5/2001 | Maurer et al. |
| 6,442,791 | B1 | 9/2002 | McRae Thomson et al. |
| 6,553,611 | B2 | 4/2003 | Huebsch et al. |
| 6,772,475 | B2 | 8/2004 | Weber et al. |
| 6,910,245 | B2 | 6/2005 | Hawkins et al. |
| 6,920,665 | B2 | 7/2005 | Tucker |
| 7,051,401 | B2 | 5/2006 | Park |
| 7,069,619 | B2 | 7/2006 | Bowden et al. |
| 7,124,467 | B2 | 10/2006 | Hitzelberger et al. |
| 7,134,164 | B2 | 11/2006 | Alton |
| 7,169,201 | B2 | 1/2007 | Oh et al. |
| 7,356,874 | B2 | 4/2008 | Skinner MacLeod et al. |
| 7,367,083 | B2 | 5/2008 | Barker et al. |
| 7,392,566 | B2 | 7/2008 | Gordon et al. |
| 7,555,810 | B2 | 7/2009 | Pullins |
| 7,634,826 | B2 | 12/2009 | Koch |
| 7,647,671 | B2 | 1/2010 | Yoshimura et al. |
| 7,662,200 | B2 | 2/2010 | Knuth et al. |
| 7,757,342 | B2 | 7/2010 | Gordon et al. |
| 7,814,612 | B2 | 10/2010 | Sepke et al. |
| 7,908,705 | B2 | 3/2011 | VanderBaan |
| 7,996,954 | B2 | 8/2011 | Lee et al. |
| 8,028,370 | B2 | 10/2011 | Gordon et al. |
| 8,122,566 | B2 | 2/2012 | Sepke et al. |
| 8,234,750 | B2 | 8/2012 | Hawkins et al. |
| 2004/0168282 | A1 | 9/2004 | Hitzelberger et al. |
| 2005/0060839 | A1 | 3/2005 | Nishinaka et al. |
| 2006/0130267 | A1 | 6/2006 | Oka et al. |
| 2008/0209668 | A1 | 9/2008 | Luebbering et al. |
| 2008/0307597 | A1 | 12/2008 | Davidshofer et al. |
| 2009/0000054 | A1 | 1/2009 | Hampton et al. |
| 2013/0198995 | A1 | 8/2013 | Eriksson |

VACUUM CLEANER EDGE CLEANING SYSTEM

BACKGROUND OF THE INVENTION

1. Field of the Invention

The present invention relates to vacuum cleaners, and, more specifically, to devices for performing cleaning operations along the edges of the vacuum cleaner's cleaning path.

2. Description of the Related Art

Upright vacuum cleaners are characterized by a base adapted to move along a floor, and a handle pivotally attached to the base (in some rare instances, the handle may be at a fixed angle to the base). The base and handle form one or more enclosures that contain a suction motor (a combined electric motor and impeller fan), a dirt collection system (e.g., a bag chamber or a cyclonic or inertial separation system), and one or more airflow passages to convey dirt-laden air through the dirt collection system. The suction motor and dirt collection system may be located in the base or the handle, and the airflow passages may comprise a series of rigid pipes, chambers, flexible hoses, and the like, as known in the art.

In a typical upright vacuum cleaner, the airflow passage system has a main inlet for cleaning large areas of the floor. The vacuum cleaner also may include an auxiliary inlet located on a flexible hose to permit cleaning in tight spaces and above the floor. The main inlet is located at the bottom of the base, and usually is elongated in the lateral direction (that is, the direction perpendicular to the fore-aft direction of movement) so as to vacuum a wide path as the cleaner is moved back and forth on the floor.

The main inlet often is effective at removing dirt from a cleaning path located directly below the main inlet, but is less effective at removing dirt located at or beyond the main inlet's lateral edges. This may be due to reduced airflow velocity at the lateral edges of the main inlet, occluded airflow at the lateral edge regions, or other factors. Reduced edge cleaning efficiency is not a problem for cleaning open areas, as the main inlet can be moved back and forth along laterally overlapping paths to fully clean the area. Edge cleaning effectiveness can, however, become a problem along walls, furniture, and other obstacles that prevent the user from passing the main inlet directly over the floor. This problem is magnified on carpeted floors, due to the carpet interfering with the free movement of air to entrain dirt embedded in the carpet fibers. Effective edge cleaning also may become more problematic with increased distances between the lateral side of the base and the lateral edge of the main inlet. For example, some upright vacuum cleaners have wheels or brush drive assemblies located between the edge of the main inlet and the outer edge of the base, thus increasing the distance that the dirt must travel to be sucked into the main inlet.

Prior vacuum cleaning systems have attempted to enhance edge cleaning performance by providing airflow passages that concentrate the suction along one or both edges of the base. For example, U.S. Pat. No. 3,942,216 shows a vacuum cleaning head having a small side inlet at each lateral end of the main inlet, and a valve to selectively direct the airflow to either side inlet for edge cleaning. This manually-operated device requires the user to bend down and turn the valve whenever edge cleaning is desired. Another edge cleaning device is shown in U.S. Pat. No. 6,039,817, which shows edge cleaning openings located near the edges of the main inlet, and a variety of different configurations to selectively direct the airflow to the edge inlets. Other examples of edge cleaning systems are shown in U.S. Pat. Nos. 3,205,528; 7,124,467 and 7,134,164 and U.K. Application No. GB4378643A. The foregoing are all incorporated by reference herein.

Despite earlier efforts to provide effective edge cleaning systems, there still exists a need to provide a simple, reliable and effective edge cleaning system that can be incorporated into upright vacuum cleaners or other cleaning systems.

SUMMARY

In one exemplary embodiment, there is provided a vacuum cleaner having a base and a handle pivotally connected to the base by a pivot. The base has a lower surface configured to face a surface to be cleaned, and first and second side edges that are spaced in a lateral direction to define lateral portions of an outer perimeter of the base. There is a main suction inlet on the base. The main suction faces the surface to be cleaned, and is elongated in the lateral direction. There also is a first edge cleaning inlet on the base facing the surface to be cleaned. The first edge cleaning inlet is located adjacent the first side edge of the base. Mounted on the handle is a first valve having a main floor cleaning inlet, an auxiliary cleaning inlet, a valve outlet, a first flow controller movable between a main floor cleaning position in which the valve outlet is fluidly connected to the main floor cleaning inlet, and an auxiliary cleaning position in which the valve outlet is fluidly connected to the auxiliary cleaning inlet, and a first actuator configured to move the first flow controller between the main floor cleaning position and the auxiliary cleaning position. A first suction passage fluidly connects the main suction inlet to the main floor cleaning inlet, and a second suction passage fluidly connects the first edge cleaning inlet to the auxiliary cleaning inlet. Also mounted on the handle is a second valve having a second flow controller movable between an edge cleaning position in which the first edge cleaning inlet is in fluid communication with the auxiliary cleaning inlet, and an accessory cleaning position in which the first edge cleaning inlet is not in fluid communication with the auxiliary cleaning inlet, and a second actuator configured to move the second flow controller between the edge cleaning position and the accessory cleaning position. An accessory hose is provided with an open distal end and a flexible hose fluidly connecting the open distal end to the auxiliary cleaning inlet. The handle has an accessory hose mount that is configured to hold the accessory hose in a hose storage position in which the accessory hose contacts the second actuator to hold the second flow controller in the edge cleaning position. A dirt separator is mounted on the handle and has a dirt separator inlet in fluid communication with the valve outlet. A suction motor is operatively associated with the handle or the base, and is configured to generate a suction airflow through the dirt separator. The suction airflow may be selectively received, by operation of the first valve and the second valve, from each of the main suction inlet, the first edge cleaning inlet, and the open distal end of the accessory hose.

The recitation of this summary of the invention is not intended to limit the claims of this or any related or unrelated application. Other aspects, embodiments, modifications to and features of the claimed invention will be apparent to persons of ordinary skill in view of the disclosures herein.

BRIEF DESCRIPTION OF THE DRAWINGS

A better understanding of the exemplary embodiments may be understood by reference to the attached drawings, in which like reference numbers designate like parts. The drawings are exemplary and not intended to limit the claims in any way.

DETAILED DESCRIPTION

Figure 1:
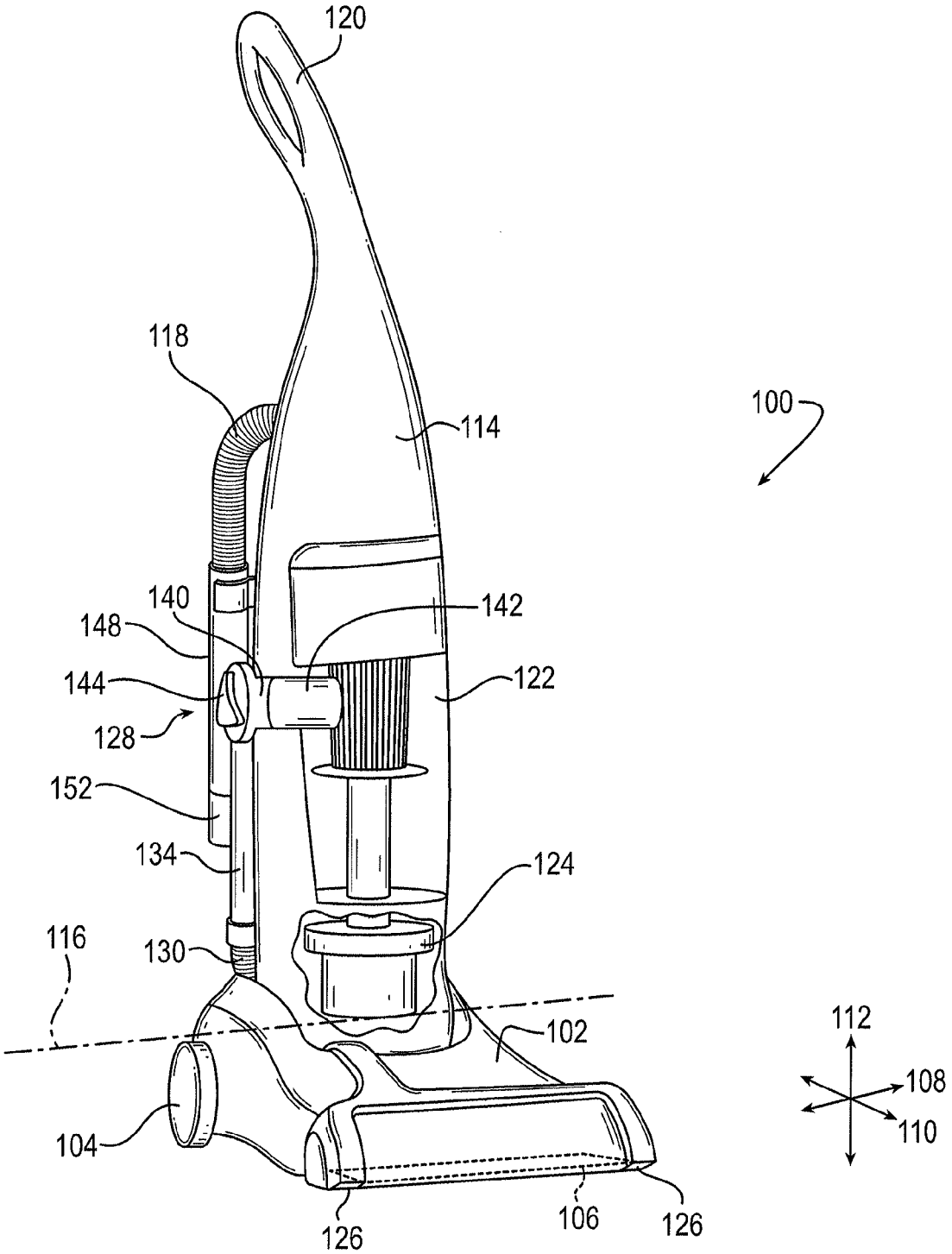
FIG. 1 is a front view of an exemplary upright vacuum cleaner having an embodiment of an edge cleaning system.
Figure 2:
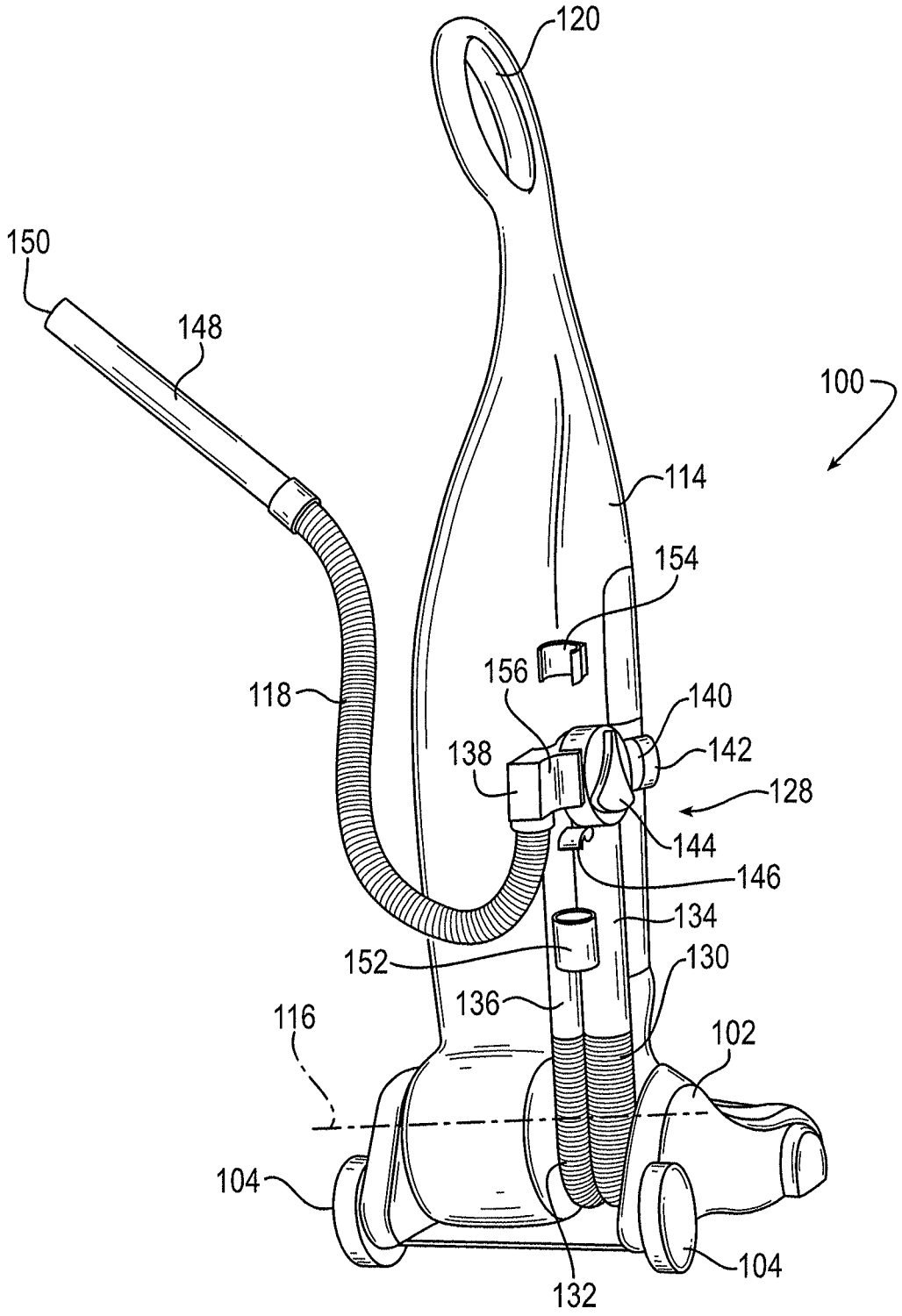
FIG. 2 is a rear view of the vacuum cleaner of FIG. 1.

FIGS. 1 and 2 illustrate an example of an upright vacuum cleaner 100 that may incorporate edge cleaning features for directing a focused suction airflow to the lateral edges of a main suction inlet on a vacuum cleaner base 102. Typical features of upright vacuum cleaners are described in more detail in U.S. Pat. Nos. 6,553,611; 6,910,245; 7,662,200; 8,122,566; and 8,234,750 and U.S. Patent Publication Nos. 2008/0307597 and 2009/000054. The foregoing patents and publications are incorporated herein by reference.

The exemplary vacuum cleaner 100 includes a base 102 that is adapted to move on a horizontal surface, such as a carpeted or bare floor. Such floor movement capability may be provided by mounting wheels 104, skids, rollers, or other devices on the bottom surface of the base 102, as known in the art. The base includes a main suction inlet 106 that faces downward from the bottom of the base 102. A rotatable brush-roll (not shown) or other agitator may be provided in or near the main suction inlet 106, as known in the art. The main suction inlet 106 typically is located at the front of the base 102, and extends along a lateral direction 108 that is perpendicular to the typical fore-aft direction 110 of the typical cleaning stroke. The fore-aft direction 110 may be dictated by the rolling axis of the wheels 104 (if they have fixed axles), by the ergonomic shape of the vacuum cleaner 100 being adapted to allow the user to most easily move the vacuum cleaner 100 in a particular direction, by a suggestion in an operation manual, or by other means, as understood in the art. The fore-aft direction 110 and lateral direction 108 lie in the plane of the surface being cleaned, and are perpendicular to an up-down direction 112 that is orthogonal to the surface. As a matter of expedience, the surface being cleaned is described herein as being horizontal (i.e., perpendicular to the vertical axis of gravitational pull), but the vacuum cleaner 100 could easily be operated on inclined, undulating, or curved surfaces.

A handle 114 is connected to the base 102 by a pivot that permits the handle 114 to rotate relative to the base 102 about a pivot axis 116. Such pivots are known in the art and need not be described herein. The handle 114 may move from an upright position, as shown, to an inclined position in which the handle 114 is leaned back (away from the front of the base 102) at a predetermined angle or range of angles. For example, the handle 114 may pivot from an upright position in which it is generally aligned with the up-down direction 112, to a reclined position that is nearly parallel with the fore-aft direction 110. As the vacuum cleaner 100 is operated, the handle 114 may be continuously raised and lowered during the forward and backward strokes. A handle lock (not shown) may be provided to lock the handle 114 in the upright position to prevent the vacuum cleaner 100 from falling over during periods of non-use or while cleaning with an accessory hose 118. A grip 120 is located at the top of the handle for use in operating and moving the vacuum cleaner 100.

The vacuum cleaner 100 includes a cleaning system for removing and capturing dirt and debris from the surface being cleaned. In the example of FIGS. 1 and 2, the cleaning system comprises a dirt separator 122 provided in the form of a single- or multi-stage cyclone separator, but this cyclone system may be readily interchanged with other kinds of inertial separators or a bag filter system. A suction motor 124 is provided upstream or, more preferably, downstream of the dirt separator 122. The suction motor 124 generates a vacuum that generates a working airflow through the dirt separator 122. A series of conduits (not shown) are provided in the vacuum cleaner 100 to direct the working airflow through the vacuum cleaner 100 to form one or more suction flow paths. The suction motor 124 may be located in the handle 114, such as shown, or in the base 102, as known in the art. One or more additional filtering devices, such as planar or pleated filters, may be provided up- or down-stream of the suction motor 124 to provide additional air filtration.

The dirt separator 122 is located downstream of dirty air inlets through which dirt-laden air enters the vacuum cleaner 100. The vacuum cleaner 100 includes a main suction inlet 106 and an accessory hose 118 that form two separate dirty air inlets into the vacuum cleaner 100. In addition, the vacuum cleaner 100 has one or more edge cleaning inlets 126 that may be located on the base 102 near the lateral edges of the main suction inlet 106. The edge cleaning inlets 126 provide a third (or more) dirty air inlet into the vacuum cleaner 100

The vacuum cleaner 100 includes one or more mechanisms to selectively direct the working airflow through the main suction inlet 106, the accessory hose 118, and the edge cleaning inlets 126. In the shown embodiment, the vacuum cleaner 100 includes a valve assembly 128 to which the three inlets are fluidly connected.

The main suction inlet 106 may be connected to the valve assembly 128 by a first flexible hose 130, and the edge cleaning inlets 126 may be connected to the valve assembly 128 by a second flexible hose 132. The first and second flexible hoses 130, 132 provide a fluid connection while allowing the base 102 and handle 114 to pivot relative to one another. The base 102 includes rigid internal passages (shown schematically in subsequent Figures) that connect the main suction inlet 106 and edge cleaning inlets 126 to the first and second flexible hoses 130, 132, respectively. The first and second flexible hoses 130, 132 may join the valve assembly 128 by respective first and second rigid pipes 134, 136, respectively, but they alternatively may extend all the way to the valve assembly 128. The accessory hose 118 may connect to the valve assembly 128 at an auxiliary inlet plenum 138. As explained below, the second rigid pipe 136 also may join at the auxiliary inlet plenum 138.

The valve assembly 128 is also connected to the dirt separator 122. In the shown embodiment, a valve outlet passage 140 fluidly connects the valve assembly 128 directly to an air inlet volute 142 that leads into the cyclonic dirt separator 122.

The flexible hoses 130, 132, rigid pipes 134, 136, auxiliary inlet plenum 138, and valve outlet passage 140 are illustrated as being external to the housing that forms the main body of the handle 114. This arrangement facilitates reconfiguration to an alternative arrangement that excludes an accessory hose 118 or edge cleaning inlets 126, which may improve the ability to provide a variety of different products based on the same basic handle platform. However, this arrangement is not required in all embodiments, and one or more of the passages that form or connect to the valve assembly 128 may be internal to the handle 114.

Referring now also to FIGS. 3A-3D, the valve assembly 128 also includes one or more valves or manipulatable connections to reconfigure the airflow passages to selectively connect the dirt separator 122 to one or more of the main suction inlet 106, accessory hose 118 or edge cleaning inlets 126. The example shown in FIGS. 1 and 2 includes a first actuator 144 that is connected to a first valve 300 (shown as a rotary valve) located inside the valve assembly 128. The exemplary first actuator 144 may be shaped as a dial-shaped knob that the user can manually move to reposition the first valve 300.

The valve assembly 128 also may include a second actuator 146 that is connected to second valve 302 (shown as a flapper valve) inside the valve assembly 128. The exemplary second actuator 146 is shaped as a lever that is moved by placing the accessory hose 118 into an idle position. More specifically, the accessory hose 118 preferably includes a rigid wand 148 (which may be separable from the flexible portion of the accessory hose 118) that operates the second actuator 146 when the wand 148 is stowed on the handle 114. In the shown embodiment, the wand 148 is stowed by placing the distal end 150 of the wand into a receiver 152 located on the handle 114, and snapping a proximal portion of the wand 148 into a clip 154 located above the receiver 152. With the wand 148 so mounted, a medial portion of the wand 148 contacts and moves the second actuator 146 to operate the second valve 302. The auxiliary inlet plenum 138 may include a recess 156 to accommodate the wand 148 when it is mounted, and the clip 154 may be integrated into this recess 156.

Figure 3A:
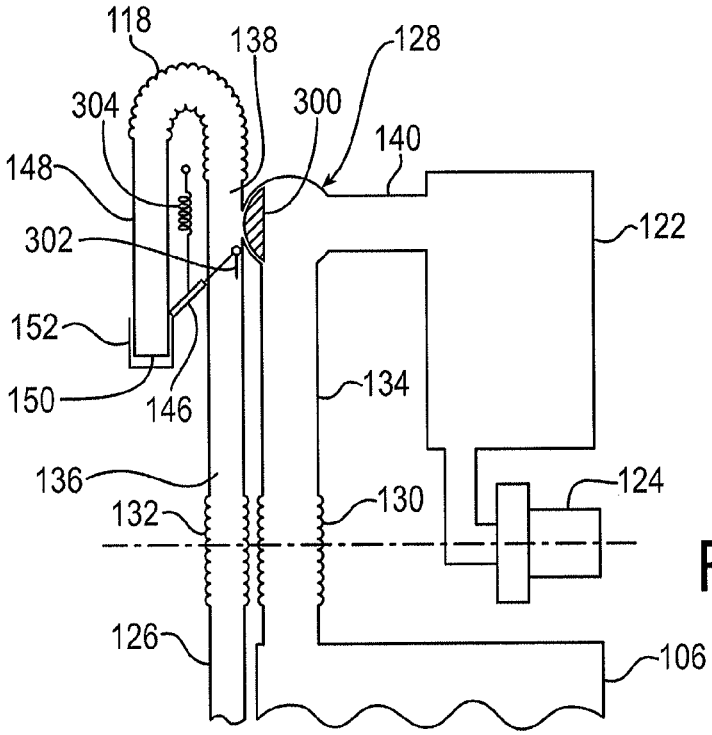
FIGS. 3A-3D are schematic views of an exemplary flow path switching arrangement, showing four different operating positions.
Figure 3B:
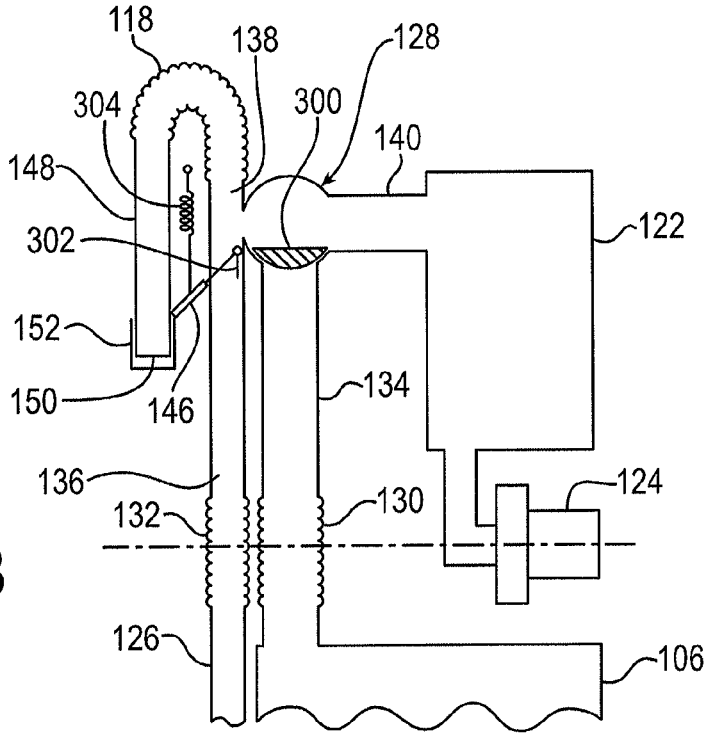
Figure 3C:
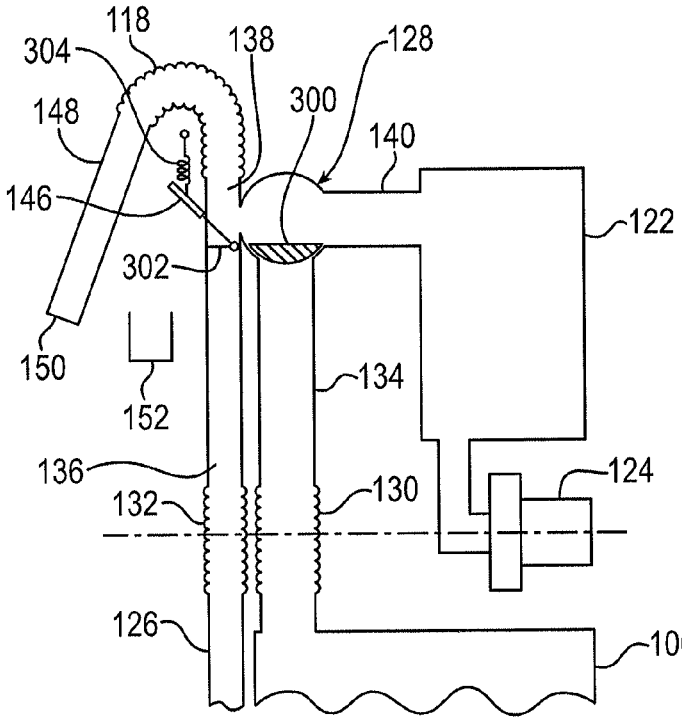
Figure 3D:
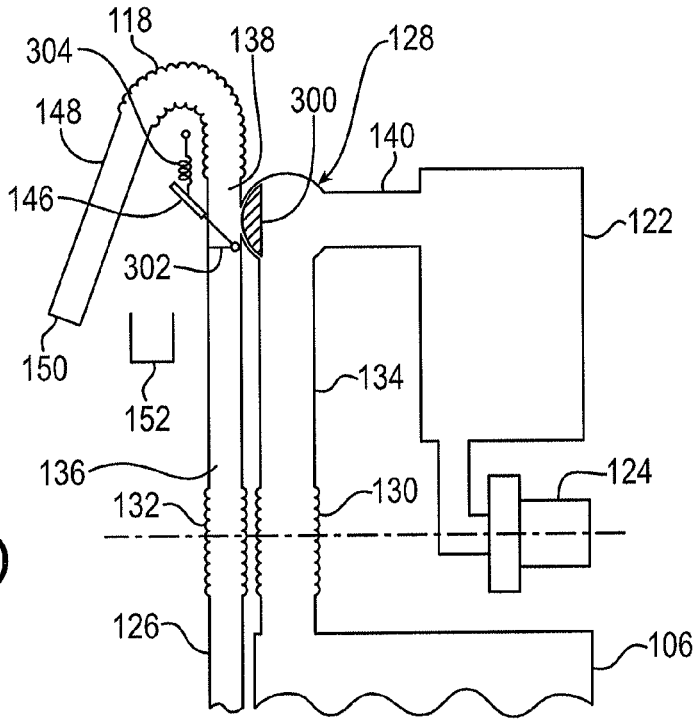

The operating states of the valve assembly 128 are illustrated schematically in FIGS. 3A-3D. FIGS. 3A and 3D show the first valve 300 in a main floor cleaning position, in which it provides an open flow path between the main suction inlet 106 and the dirt separator 122, and blocks fluid communication between the auxiliary inlet plenum 138 and the dirt separator 122. This configuration is used for cleaning large areas of the underlying surface by sucking dirt and debris into the main suction inlet 106. When the first valve 300 is in the floor cleaning position, suction is not applied to the auxiliary inlet plenum 138, and therefore floor cleaning can continue regardless of whether the accessory hose wand 148 is mounted to the housing (FIG. 3A) or dismounted from the housing (FIG. 3D).

FIGS. 3B and 3C show the first valve 300 in an auxiliary cleaning position, in which is provides an open flow path between the auxiliary inlet plenum 138 and the dirt separator 122, and blocks fluid communication between the main suction inlet 106 and the dirt separator 122. In this embodiment, the auxiliary inlet plenum 138 provides a common connection to both the accessory hose 118 and the edge cleaning inlets 126. (Note that the edge cleaning inlets 126 are depicted schematically as a single inlet, but in physical embodiments there may be one or any number of such inlets into the base 102.) As such, this configuration of the first valve 300 is used for edge cleaning through the one or more edge cleaning inlets 126, or accessory cleaning through the accessory hose 118.

The selection between edge cleaning and accessory cleaning is determined by the position of the second valve 302. FIG. 3B shows an edge cleaning configuration, in which the second valve 302 is open to permit fluid communication between the edge cleaning inlets 126 and the auxiliary inlet plenum 138, and the open distal end 150 of the wand 148 is mounted in and blocked off by the receiver 152. Thus, airflow generated by the suction motor 124 is directed to the edge cleaning inlets 126 to provide concentrated cleaning at the locations of the edge cleaning inlets 126. The receiver 152 and open distal end 150 may interact in any suitable way to block airflow. For example, the receiver 152 may comprise a cup that seals around the outside of the wand 148, a plug that seals inside the open distal end 150 of the wand 148, a flat surface against which the open distal end 150 seals, or a combination of sealing structures. O-rings, lip seals, face seals or other types of seal made of any composition of matter may be used.

FIG. 3C shows an accessory cleaning configuration, in which the second valve 302 is closed to block fluid communication between the edge cleaning inlets 126 and the auxiliary inlet plenum 138, and the wand 148 is dismounted from the handle to provide an open airflow path into the open distal end 150 of the wand 148. In this configuration, the suction airflow is directed to the accessory hose 118 and wand 148 for cleaning above the floor or in locations that cannot be readily accessed by the main suction inlet 106 or edge cleaning inlets 126. The accessory hose 118 also may be used to provide a highly-concentrated airflow on a floor surface to clean deeply-embedded particles that are not removed by the main suction inlet 106 or edge cleaning inlets 126.

In this exemplary embodiment, the second valve 302 opened (FIG. 3B) by the wand 148, such as described above in reference to FIG. 2. The second valve 302 may also be closed (FIG. 3B) by interaction a with the wand 148. For example, the wand 148 may include a catch that pulls up on the second actuator 146 as the wand 148 is pulled upwards out of the receiver 152. In the shown embodiment, a spring 304 or other resilient mechanism is required with the second actuator 146 to move the second valve 302 to the closed position when the wand 148 is removed. Such a spring 304 may comprise any suitable shape (e.g., a coil spring, a leaf spring, or a resilient block) or material (e.g., metal, plastic, elastomeric, etc.). The exemplary spring 304 comprises a coil spring that is connected at one end to the second actuator 146 and at the other end to part of the handle 114.

The foregoing arrangement is expected to provide significant benefits. An ongoing concern with vacuum cleaners is the need provide simple and intuitive controls. With the embodiment described above, the user is only required to select between main floor cleaning and auxiliary cleaning. In the auxiliary cleaning position, the airflow is automatically switched to accessory cleaning whenever the user removes the wand 148. Thus, the user can begin accessory cleaning without taking any additional steps to reconfigure the vacuum cleaner. The vacuum cleaner is switched back to the edge cleaning configuration when the wand 148 is replaced on the handle 114, without requiring further user intervention, and without risk that the user will inadvertently leave the controls in the incorrect position when edge cleaning is desired. This arrangement also allows the operator to switch to the accessory cleaning configuration while the handle 114 is reclined, which is not possible in an arrangement that would activate the second valve 302 automatically by placing the handle 114 in the upright position.

A further advantage of the foregoing embodiment is that the airflow path for the edge cleaning inlets 126 is relatively short, and does not pass through the accessory hose 118. This should provide measurably stronger suction at the edge cleaning inlets 126, for a given suction motor 124, than configurations that pass the edge cleaning airflow through an accessory hose. This is due to flow resistance caused by factors such as the longer air passage through the accessory hose 118, corrugations inside the hose, excess convolutions and turns in the hose, and the typically smaller cross-sectional area of the hose as compared to a fixed passage.

The foregoing embodiment also provides an advantage by locating both valves 300, 302 on the handle, rather than placing one or the other on the base, despite the added complexity of requiring a second airflow path through the articulating handle pivot joint. In this configuration, the user can control both valves 300, 302 without having to reach all the way to the base 102 (a significant advantage for some consumers), and selection between the two auxiliary cleaning modes can be tied directly to operating the accessory hose 118.

Other advantages are expected to be found by practice of the foregoing embodiment, and other embodiments described herein. It will be appreciated, however, that the claims are not intended to be limited to the foregoing embodiment or to necessarily exclude features described as being less desirable than others.

Figure 4A:
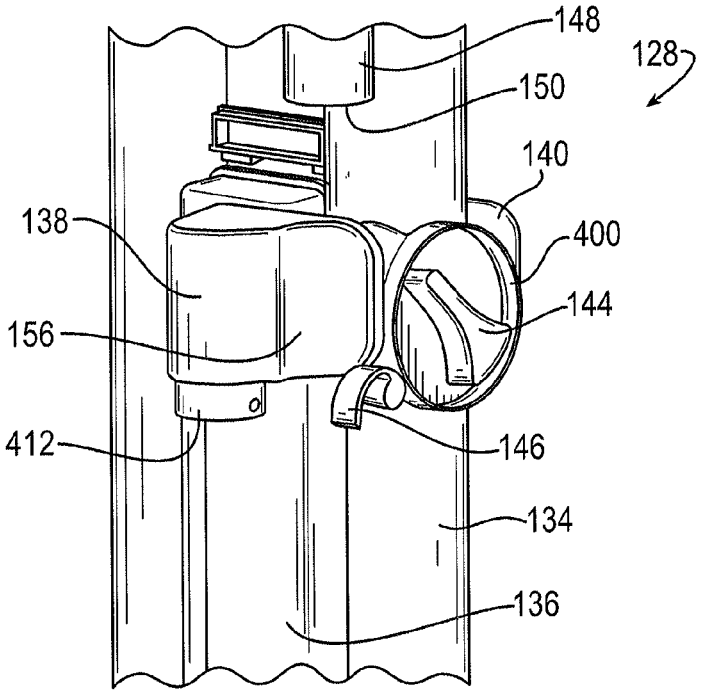
FIG. 4A is an isometric view of an exemplary valve assembly that may be used in an upright vacuum cleaner handle, shown with an associated wand removed from the vacuum cleaner handle.
Figure 4B:
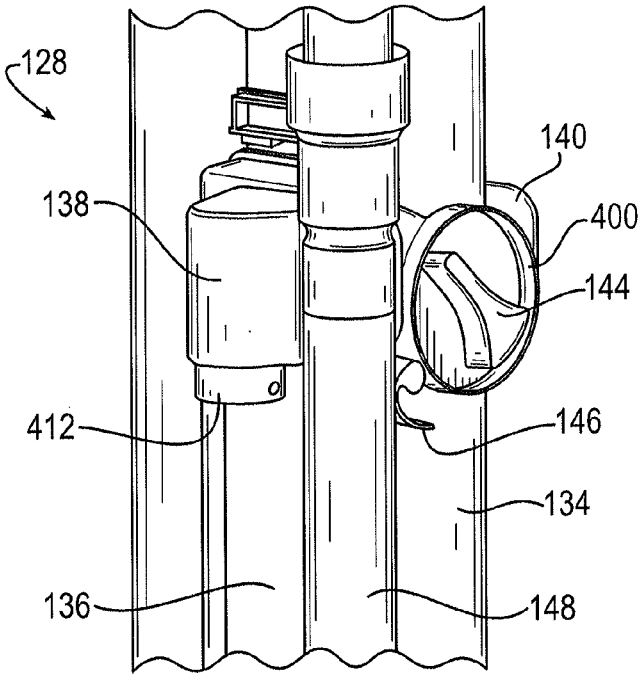
FIG. 4B is an isometric view of the valve assembly of FIG. 4A with the associated wand mounted to the vacuum cleaner handle.
Figure 4C:
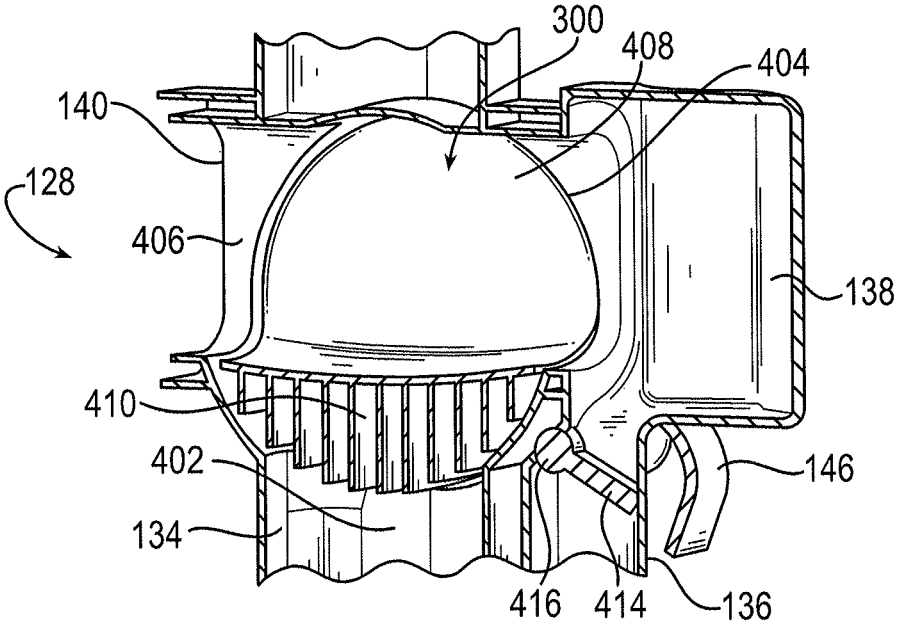
FIG. 4C is a cutaway view of the valve assembly of FIG. 4A.

FIGS. 4A-4C show an exemplary construction of the valve assembly 128 in more detail. As shown in FIG. 4A, the valve assembly includes first and second pipes 134, 136 that lead to the main suction inlet 106 and edge cleaning inlets 126, respectively. The pipes 134, 136 may be rigid, as shown, or flexible. In this embodiment, at least the first pipe 134 is rigid, and it may form part of the handle's structure. The first valve 300 is contained in a generally cylindrical valve housing 400, and the first actuator 144 is located outside the valve housing 400 or access by the user. The valve housing 400 includes a first inlet 402, a second inlet 404, and an outlet 406. The first inlet 402 is fluidly connected to the first pipe 134, which mates to the bottom of the valve housing 400. The second inlet 404 is fluidly connected to the auxiliary inlet plenum 138, which mates to a side of the valve housing 400. The outlet 406 is fluidly connected to the outlet passage 140.

The exemplary first valve 300 includes a rotating plate 408 to which the first actuator 144 is connected, and a flow controller, such as a gate 410, mounted to the rotating plate 408. Rotating the first actuator 144 rotates the plate 408, which repositions the gate 410 in front of either the first inlet 402 or the second inlet 404. If desired, the gate 410 also may be movable to a third position in which airflow through both inlets 402, 404 is permitted, which may be desirable to obtain a blend of main floor cleaning and edge cleaning. The rotating plate 408 may be rotatably mounted to the valve housing 400 on pins that fit in corresponding bosses or by similar rotating mounts, and bearings or bushings may be provided at the rotating mounts, if desired, to provide smooth operation. One or more seals (not shown) may be provided around the perimeter of the gate 410 or the inlets 402, 404, if desired, to enhance the air-blocking operation of the gate 410.

The auxiliary inlet plenum 138 is fluidly connected to the second pipe 136 and a hose connector 412. A proximal end of the accessory hose 118 is fluidly connected to the hose connector 412, and may be removable to replace the hose if it is damaged or to clear out blockage. In this embodiment, the second pipe 136 and hose connector 412 connect to the bottom of the auxiliary inlet plenum 138, but other orientations may be used in other embodiments. As noted above, the auxiliary inlet plenum 138 also may include a recess 156 to receive the wand 148 when the wand 148 is mounted to the handle 114.

The second valve 302 of the exemplary embodiment comprises a flap 414 that extends radially from a shaft 416. The flap 414 and shaft 416 are mounted inside the second pipe 136 adjacent the auxiliary inlet plenum 138, such as shown in FIG. 4C. the shaft 416 is rotatably mounted to allow the flap 414 to selectively block the second pipe 136. Such mounting may be provided by extending ends of the shaft through corresponding holes on each side of the second pipe 136. Bearings or bushings may be provided to provide smoother operation, and air seals may be provided to inhibit air leaks into the second pipe 136 and prevent the accumulation of dirt at the rotation mount.

The second valve 302 is operatively connected to the second actuator 146. In this example, the second actuator 146 may be connected directly to an end of the shaft 416 that protrudes outside the second pipe 136. The second actuator 146 may be located adjacent the recess 156 (if one is provided), so that the wand 148 moves the second actuator 146 when it is mounted to the handle 114. This operation is illustrated by comparing FIG. 4A, which shows the wand 148 dismounted from the handle 114, and FIG. 4B, which shows the wand 148 mounted to the handle 114. The second actuator 146 may be exposed, such as shown, to allow a user to manually move it, or it may be concealed inside a housing or passage to inhibit or prevent direct user operation.

The second actuator 146 may have any useful shape. In the present example, it is shaped as a cam-shaped curved arm that extends from a central boss that is connected to the shaft 416. Portions of the curved arm face upward and laterally so that the arm may be operated by pressing on it vertically, horizontally, or at angles in between. This allows the user to move the wand 148 into the recess 156 from a wide variety of directions to move the second actuator 146 to the edge cleaning configuration. For example, a user preferably may operate the second actuator 146 by first holding the wand 148 at an angle from vertical (e.g., 45 degrees from vertical), second, inserting the open distal end 150 of the wand 148 into the receiver 152, and third, pivoting the wand 148 about the receiver 152 until it rests in the recess 156 and presses against the second actuator 146 to operate the second valve 302.

It will be appreciated that the second valve 302 may be moved to alternative locations—for example, the flap 414 and shaft 416 may be located within the auxiliary inlet plenum 138. The flap 414 also may be positioned to block the second pipe 136 during accessory cleaning (as described above), and also block the hose connector 412 when the device is in the edge cleaning configuration, in which case it may not be necessary to obstruct airflow into the end of the wand 148 as described above. In alternative embodiments, the second valve 302 may comprise any other flow controller, such as a rotary valve (which may be within the auxiliary inlet plenum), a flexible hose that is moved between two connectors, a sliding gate, and so on.

One or more of the valve assembly parts (e.g., the valve housing 400, first pipe 134, auxiliary inlet plenum 138 and second pipe 136) may be integrally formed or separately made and connected to one another. These parts also may be formed with different shapes or intermediate sections (e.g., flexible hoses) to reposition the parts at different locations on the handle 114. Openable cleanout ports or transparent inspection windows may be provided to check for and remove clogs within the valve assembly 128.

It will be appreciated that the first and second actuators 144, 146 and their associated valves 300, 302 may be replaced by suitable alternative devices and operated in alternative manners. For example, the rotating first actuator 144 may be replaced with a lever or a slide, or it may be replaced by a solenoid instead of a manually-operated mechanism. As another example, the second actuator 146 may be operated by a flexible portion of the accessory hose 118 instead of the wand 148, and other embodiments may omit the wand 148 or reduce it to the size of a hose connection cuff. The second actuator 146 also may be operated other than by contact with the accessory hose 118; for example, it may comprise a knob or lever that is configured to be operated solely by the user's hand, be replaced by a solenoid, or be operated by other mechanisms, such as a pushrod that operates the second actuator 146 when the handle 114 is placed in the upright position. The actuators 144, 146 also may be located remotely from the valves 300, 302, and operatively connected by rods, cables or the like. Where solenoids or other electrically-powered actuators are used, electrical controls may be provided on the grip 120, wand 148, or at other locations, and connected via wires or wireless communication devices. Also, the receiver 152 and clip 154 may be replaced by alternative structures, moved, or reoriented.

Varieties of alternative valves and flow-switching mechanisms, such as alternative devices for operating a valve upon stowing a wand in a vacuum cleaner handle, valve structures, and linkages to drive a valve, are shown in U.S. Pat. Nos. 3,879,797; 5,355,549; 5,477,586; 6,442,791; 6,920,665; 7,356,874; 7,555,810; 7,996,954 and 8,234,750, and U.S. Publication No. 2008/0209668. Each of the foregoing is incorporated herein by reference in its entirety. Features shown in these and other devices may be used in other embodiments of the invention, as will be understood by persons of ordinary skill in the art in view of the present disclosure. The foregoing variations are not intended to be a limiting list, and other variations and modifications will be apparent to persons of ordinary skill in the art in view of the present disclosure.

The vacuum cleaner 100 may include suitable markings or instructions to direct the user in selecting the various cleaning configurations. For example, the first actuator 144 may have an arrow (or an arrow-like shape) that points towards a first legend indicating "floor cleaning" when the first valve 300 is in the main floor cleaning position, and points towards a second legend indicating "edge/wand cleaning" when it is in the auxiliary cleaning position. The handle 114 also may include a legend directing the user to "install wand for edge cleaning." Symbols or alternative text legends may be used in other embodiments.

Figure 5:
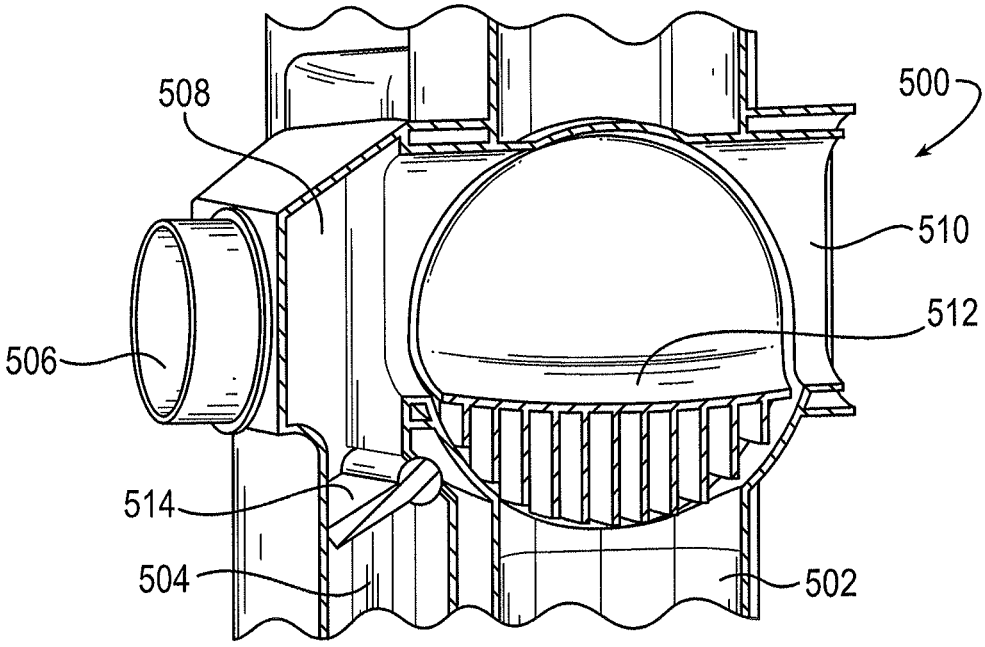
FIG. 5 is a cutaway view of another exemplary valve assembly that may be used in an upright vacuum cleaner handle.

FIG. 5 shows another example of a valve assembly 500 that may be used to selectively connect a vacuum cleaner dirt separator to a main suction inlet, edge cleaning inlet(s), or an accessory hose. The valve assembly 500 includes a first inlet passage 502 that may be connected to a main suction inlet, a second inlet passage 504 that may be connected to one or more edge cleaning inlets, and a third inlet passage 506 that may be connected to an accessory hose. An inlet plenum 508 fluidly joins the second and third inlet passages 504, 506, and an outlet passage 510 leads out of the valve assembly 500 and may be connected to any variety of dirt separating system. A first valve 512 is located, in a fluid sense, at the junction of the first inlet passage 502, the inlet plenum 508, and the outlet passage 510. The first valve 512 may be rotated to selectively block airflow to either the first inlet passage 502 or the inlet plenum 508. A second valve 514 is provided to selectively block airflow through the second inlet passage 504. In this example, the third inlet passage 506 comprises a hose connector that faces laterally sideways. This arrangement provides for relatively simple servicing of the inlet plenum 508 and first valve 512 after removing the hose (not shown) from the third inlet passage 506.

Figure 6:
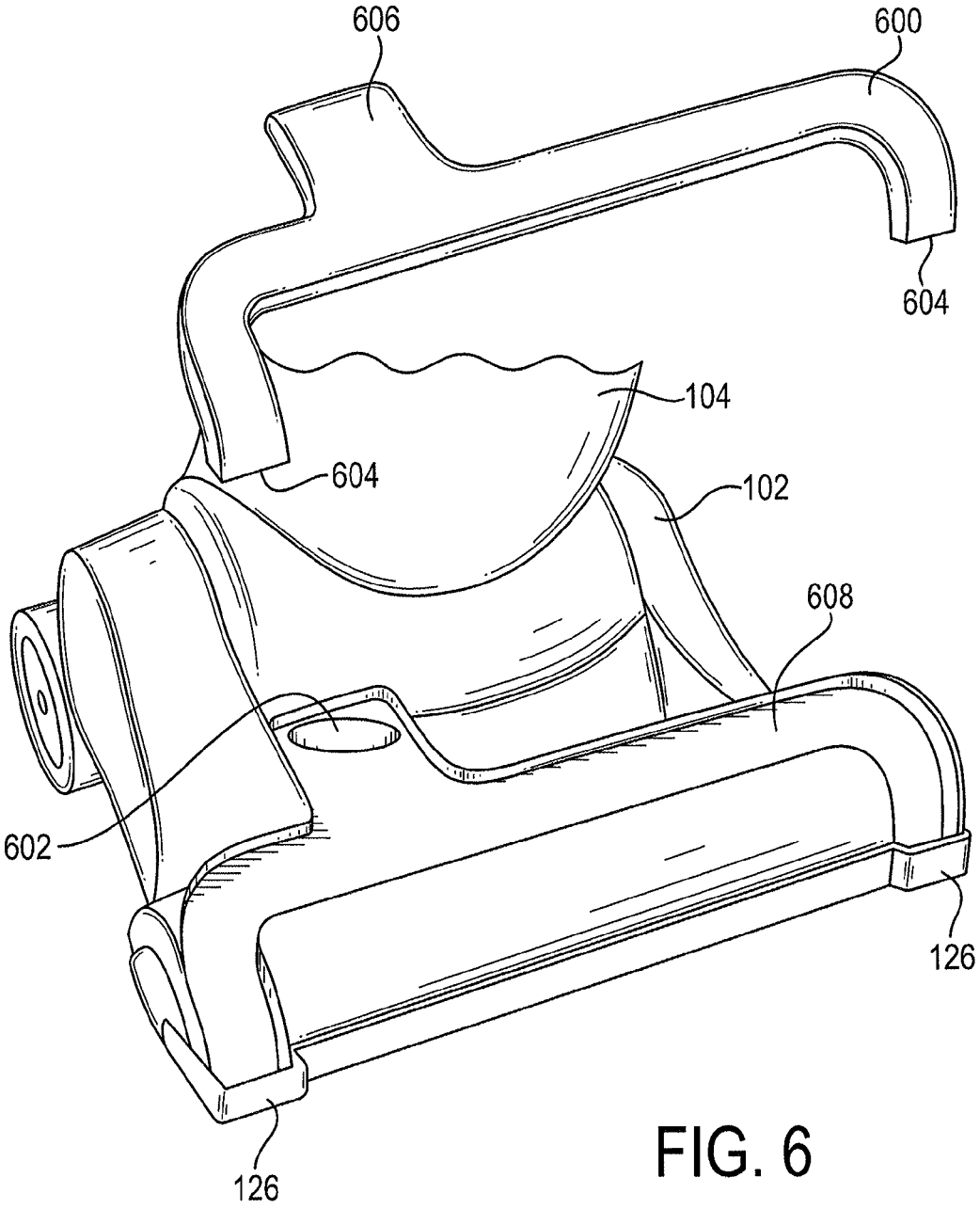
FIG. 6 is an isometric view of an exemplary vacuum cleaner base having a removable edge cleaning plenum, shown disassembled.

Referring to FIG. 6, embodiments of an edge cleaning system may include a removable or openable edge cleaning plenum 600 that provides air communication between the edge cleaning inlets 126 and a hose connection 602. The hose connection 602 preferably comprises a passageway through the base 102 that joins with the second flexible hose 132 by a removable connector (not shown). The plenum 600 comprises a downward-facing channel having branches 604 leading to each edge cleaning inlet 126, and an outlet region 606 that overlies the hose connection 602. When the plenum 600 installed, the branches 604 fit into the edge cleaning inlets 126, and the outlet region 606 covers the hose connection 602. Snaps, screws, tabs, or other fastening structures are provided to secure the plenum 600 in place on the base 102. Examples of devices that may be used to secure a removable plenum 600, including sliding locks and seals, are shown in U.S. Pat. No. 7,814,612, which is incorporated herein by reference. The base 102 also may include a corresponding channel 608 into which the plenum 600 fits, or a raised wall that fits inside the plenum, that provides a means to guide and more firmly secure the plenum 600 to the base 102. One or more seals (not shown) may be provided to seal the edges of the plenum 600 to the base 102 to prevent any unwanted ingress of air. The plenum 600 may be opaque, but more preferably it is partially or entirely transparent, to readily show when it is dirty and needs to be removed for cleaning.

Figure 7:
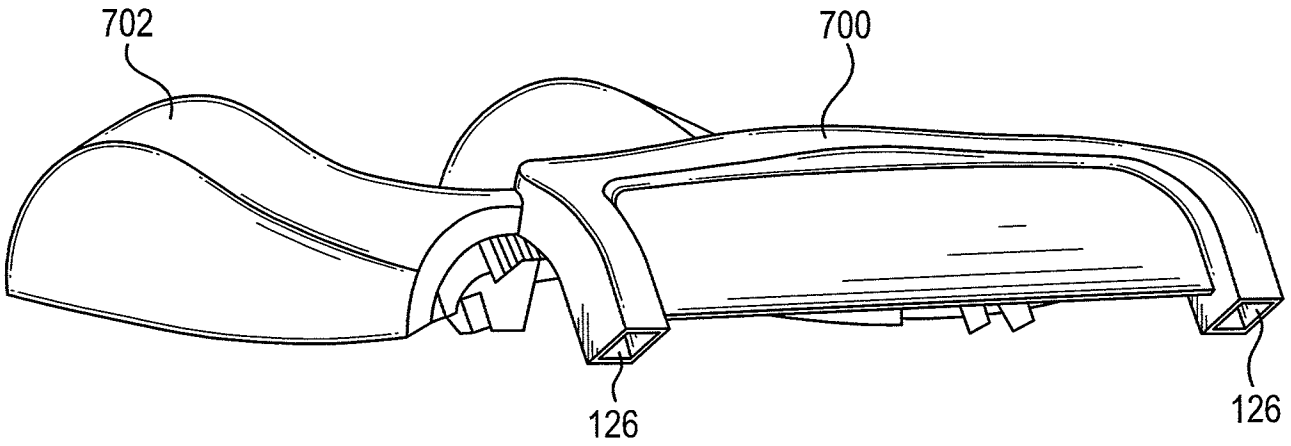
FIG. 7 is an isometric view of an exemplary vacuum cleaner base housing having an integral edge cleaning plenum.

Referring to FIG. 7, the base 102 alternatively may have a permanently attached plenum 700. In the exemplary embodiment of FIG. 7, the plenum 700 is molded as part of an upper housing shell 702 that forms the top of the base 102. Other embodiments may locate the plenum elsewhere, such as in a lower housing shell (not shown), or the plenum 700 may be provided as a separate molded part that is secured inside or otherwise attached (e.g., by adhesive bonding) to the base 102. In FIG. 7, the plenum also includes a separate branch for each edge cleaning inlet 126. Portions of the plenum 700 may be formed of transparent material. For example, an upper surface of the plenum 700 may comprise a molded polycarbonate part that is molded in place with the rest of the housing shell 702). The plenum 700 may include cleanout ports or removable sections to facilitate cleaning.

FIG. 7 depicts the housing shell 702 as viewed in the horizontal plane, and thus as it would appear if it was installed on a vacuum cleaner with the vacuum cleaner's base flat on a surface being cleaned. This view illustrates the edge cleaning inlets 126 being inclined upwards, relative to the horizontal plane, towards the front of the base. Thus, the front edge of each edge cleaning inlet 126 is higher than the rear edge thereof. This is expected to provide improved edge cleaning in front of the vacuum cleaner, and to allow a greater inrush of air to entrain debris located in corners and crevices, while still providing a generally downward-facing configuration to focus airflow directly below the edge cleaning inlet 126. The raised front edge of the edge cleaning inlets 126 in this configuration also permits the ingress of relatively large objects, such as popcorn and the like, that may accumulate in edges were a carpet joins a wall. The angle of inclination may range from about 2° to about 45° from horizontal, and more preferably is in the range of about 5° to 35° from horizontal. In other embodiments, one or both edge cleaning inlets 126 may lie in the horizontal plane to face directly down, or may lie in a vertical plane to face sideways. Other angles also may be used.

Figure 8:
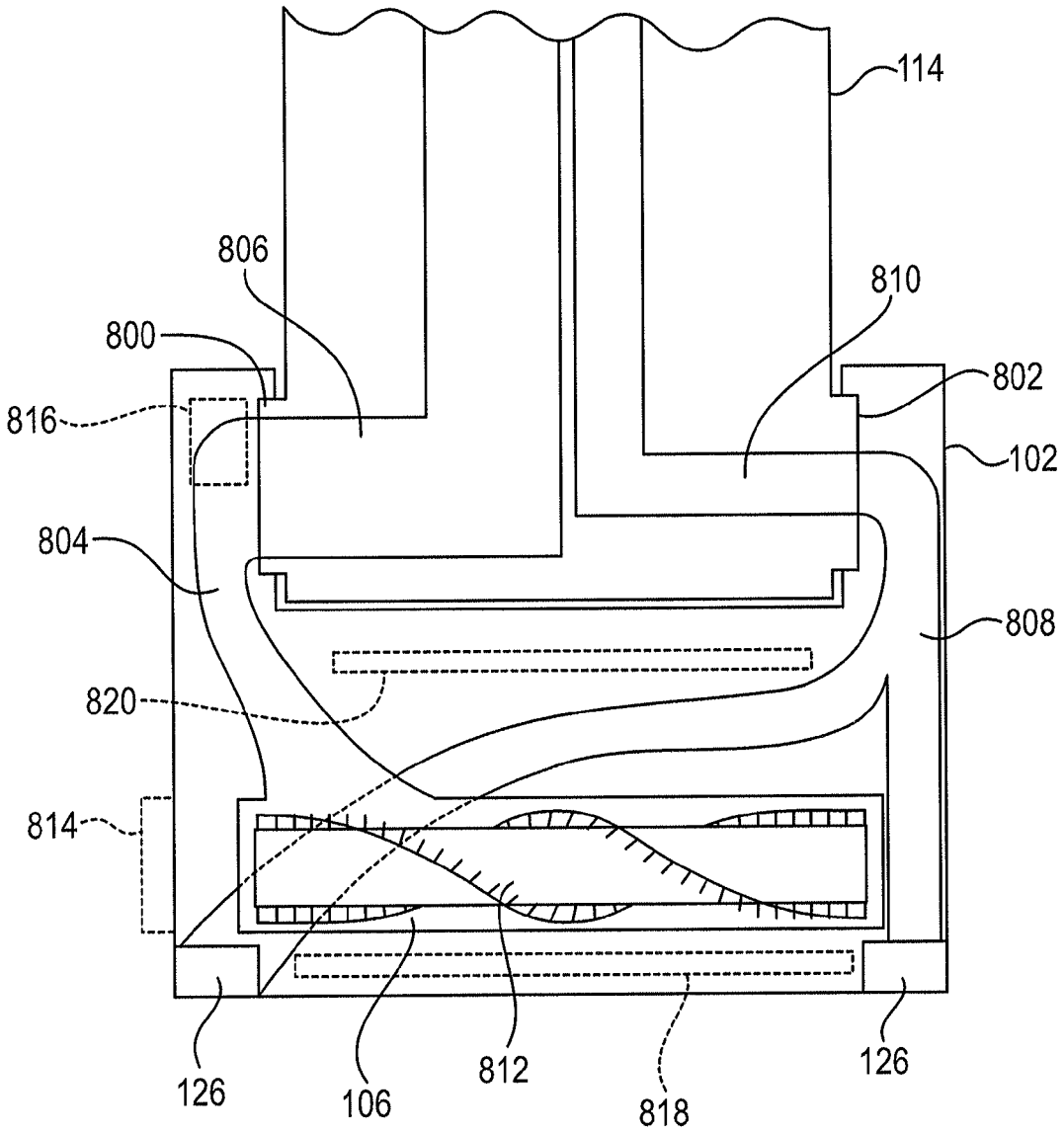
FIG. 8 is a schematic view of an exemplary embodiment of a vacuum cleaner showing various air inlet configurations.

FIG. 8 illustrates additional variations and alternative embodiments. FIG. 8 schematically illustrates an upright vacuum cleaner having a base 102 that is pivotally mounted to a handle 114 by first and second pivots 800, 802. The base 102 includes a main suction inlet 106 and a pair of edge cleaning inlets 126. The edge cleaning inlets 126 are located at the front corners of the base 102, in front of the opposite lateral ends of the main suction inlet 106. In this embodiment, the main suction inlet 106 is fluidly connected to a first base passage 804 that connects to a first handle passage 806 through the first pivot 800. Similarly, the edge cleaning inlets 126 are fluidly connected to a second base passage 808 that connects to a second handle passage 810 through the second pivot 802. In an alternative embodiment, the first and second base passages 804, 808 may be concentric and pass only through one pivot 800, 802 to mate with concentric handle passages 806, 810. This more readily allows a brushroll 812 located in the main suction inlet 106 to be driven by a shaft from a suction motor located in the handle. Using the foregoing constructions, it is not necessary for any of the passages 804, 806, 808, 810 to be a flexible hose, because the air passages extend axially through the pivots 800, 802 so that the base 102 can articulate relative to the handle about the pivots 800, 802. Nevertheless, it still many be desirable to used flexible hoses to pass through the pivots 800, 802, and an alternative embodiment may use two adjacent or concentric flexible hoses to pass through one or both pivots 800, 802.

FIG. 8 also shows a variety of alternative additional inlet locations that may be used in other embodiments. For example, a first alternative edge cleaning inlet 814 may be located on a protrusion that extends further in the lateral direction from the remaining portions of the base sidewall. Such a protruding inlet 814 may be adjacent the main suction inlet 106, or forward or behind it. A second alternative edge cleaning inlet 816 may be provided behind the main suction inlet 106, and as far back as the back edge of the base 102. Other edge cleaning inlets, single inlets, or combinations of multiple inlets may be used in other embodiments.

It also will be appreciated that other embodiments may incorporate valve mechanisms that redirect airflow to alternative inlets on the base 102 that are not intended for edge cleaning. A third alternative inlet 818 may be provided along the front edge of the main suction inlet 106, and a fourth alternative inlet 820 may be provided behind the back edge of the main suction inlet 106. Such alternative inlets 818, 820 may extend partially or entirely across the width of the base 102, and may be intended for cleaning hard floors when the brushroll 812 is not operating, or to provide periodic concentrated airflow along bare or carpeted floors. Other configurations and locations of alternative inlets that may be used for a variety of purposes also may be used, as will be appreciated by persons of ordinary skill in the art in view of the present disclosure.

The foregoing description explains how suction and airflow can be redirected in a variety of ways. It will be appreciated that some inconsequential flow may exist even when passages are closed. For example, there may be some air leakage around worn seals or at passage junctions. Also leakage may be deliberately provided to assure continuous cooling airflow to the suction motor 124 in the event the passage intended to be used is obstructed. For example, a gap may be provided between the open distal end 150 of the wand 148 and the receiver 152 to allow a predetermined amount of air to bleed into the system if the edge cleaning inlets 126 become obstructed (this feature may be particularly desirable because the edge cleaning inlets 126 may be more easily obstructed by relatively small objects without gaining the attention of the user). The disclosure and recited claims are not intended to imply that perfect seals are possible, necessary, or even desired in all circumstances. Rather, a passage that is described as being blocked or otherwise rendered inoperative is one that is not conveying sufficient suction airflow to realistically perform cleaning operations, as will be understood by persons of ordinary skill in the art in view of the present disclosure.

The present disclosure describes a number of new, useful and nonobvious features and/or combinations of features that may be used alone or together. The embodiments described herein are all exemplary, and are not intended to limit the scope of the inventions. Persons of ordinary skill in the art will appreciate and understand that the inventions described herein can be modified and adapted in various and equivalent ways, and such modifications and adaptations are intended to be included in the scope of this disclosure and the appended claims.

I claim:

1. A vacuum cleaner comprising:

a base having a lower surface configured to face a surface to be cleaned, and first and second side edges that are spaced in a lateral direction to define lateral portions of an outer perimeter of the base;

a main suction inlet on the base facing the surface to be cleaned, the main suction inlet being elongated in the lateral direction;

a first edge cleaning inlet on the base facing the surface to be cleaned, the first edge cleaning inlet being located adjacent the first side edge of the base;

a handle pivotally connected to the base by a pivot joint;

a first valve mounted on the handle, the first valve comprising:

a main floor cleaning inlet, an auxiliary cleaning inlet, a valve outlet, a first flow controller movable between a main floor cleaning position in which the valve outlet is fluidly connected to the main floor cleaning inlet, and an auxiliary cleaning position in which the valve outlet is fluidly connected to the auxiliary cleaning inlet, and a first actuator configured to move the first flow controller between the main floor cleaning position and the auxiliary cleaning position;

a first suction passage fluidly connecting the main suction inlet to the main floor cleaning inlet;

a second suction passage fluidly connecting the first edge cleaning inlet to the auxiliary cleaning inlet;

a second valve mounted on the handle, the second valve comprising:

a second flow controller movable between an edge cleaning position in which the first edge cleaning inlet is in fluid communication with the auxiliary cleaning inlet, and an accessory cleaning position in which the first edge cleaning inlet is not in fluid communication with the auxiliary cleaning inlet, and a second actuator configured to move the second flow controller between the edge cleaning position and the accessory cleaning position;

an accessory hose having an open distal end and a flexible hose fluidly connecting the open distal end to the auxiliary cleaning inlet;

an accessory hose mount located on the handle and configured to hold the accessory hose in a hose storage position in which the accessory hose contacts the second actuator to hold the second flow controller in the edge cleaning position;

a dirt separator mounted on the handle and having a dirt separator inlet in fluid communication with the valve outlet; and a suction motor operatively associated with the handle or the base, the suction motor being configured to generate a suction airflow through the dirt separator, wherein the suction airflow may be selectively received, by operation of the first valve and the second valve, from each of the main suction inlet, the first edge cleaning inlet, and the open distal end of the accessory hose.

2. The vacuum cleaner of claim 1, further comprising a second edge cleaning inlet on the base facing the surface to be cleaned, the second edge cleaning inlet being located adjacent the second side edge of the base and fluidly connected to the second suction passage.

3. The vacuum cleaner of claim 1, wherein the first edge cleaning inlet is located on a protrusion that extends in the lateral direction from the first side edge.

4. The vacuum cleaner of claim 1, wherein the first edge cleaning inlet is located between the first side edge and the main suction inlet.

5. The vacuum cleaner of claim 1, wherein the first edge cleaning inlet is located in front of the main suction inlet.

6. The vacuum cleaner of claim 1, wherein the first edge cleaning inlet is located adjacent a rear edge of the base.

7. The vacuum cleaner of claim 1, further comprising a brushroll mounted in the main suction inlet.

8. The vacuum cleaner of claim 1, wherein the first flow controller comprises a rotary valve having a gate that blocks the auxiliary cleaning inlet when the first flow controller is in the main floor cleaning position and blocks the main floor cleaning inlet when the first flow controller is in the auxiliary cleaning position.

9. The vacuum cleaner of claim 1, wherein the first actuator comprises a hand-operated knob.

10. The vacuum cleaner of claim 1, wherein the first suction passage comprises a first base passage fluidly connecting the main suction inlet to a first base outlet, a first rigid pipe mounted on the handle and fluidly connected to the main floor cleaning inlet, and a first flexible hose fluidly connecting the first base outlet to the first rigid pipe.

11. The vacuum cleaner of claim 1, wherein the second suction passage comprises a second base passage fluidly connecting the main suction inlet to a second base outlet, a second rigid pipe mounted on the handle and fluidly connected to the auxiliary cleaning inlet, and a second flexible hose fluidly connecting the second base outlet to the second rigid pipe.

12. The vacuum cleaner of claim 1, wherein at least one of the first suction passage and the second suction passage comprises a flexible hose.

13. The vacuum cleaner of claim 1, wherein the first suction passage and the second suction passage comprises respective first and second flexible hoses extending from the base to the handle.

14. The vacuum cleaner of claim 1, wherein at least one of the first suction passage and the second suction passage passes axially through the pivot joint.

15. The vacuum cleaner of claim 1, wherein the first suction passage and the second suction passage pass axially through the pivot joint.

16. The vacuum cleaner of claim 1, wherein the auxiliary cleaning inlet comprises an auxiliary inlet plenum fluidly connecting the second suction passage to the accessory hose.

17. The vacuum cleaner of claim 16, wherein the second flow controller comprises a flap valve located within the second suction passage and outside the auxiliary inlet plenum.

18. The vacuum cleaner of claim 1, wherein the second flow controller is positioned such that it does not prevent fluid communication between the accessory hose and the auxiliary cleaning inlet when the second flow controller is in the edge cleaning position.

19. The vacuum cleaner of claim 18, wherein the accessory hose mount comprises a receiver configured to block the open distal end of the accessory hose when the accessory hose is in the hose storage position.

20. The vacuum cleaner of claim 1, wherein the accessory hose further comprises a rigid wand extending from the open distal end of the accessory hose.

21. The vacuum cleaner of claim 20, wherein the wand contacts the second actuator to hold the second flow controller in the edge cleaning position when the accessory hose is in the hose storage position.

22. The vacuum cleaner of claim 21, wherein the accessory hose mount further comprises a receiver to hold the open distal end of the wand, and a clip to hold a proximal portion of the wand, and wherein the second actuator is located between the receiver and the clip.

23. The vacuum cleaner of claim 1, wherein the second actuator comprises a spring to bias the second flow controller into the accessory cleaning position.

24. The vacuum cleaner of claim 10, wherein the second suction passage comprises a second base passage fluidly connecting the main suction inlet to a second base outlet, a second rigid pipe mounted on the handle and fluidly connected to the auxiliary cleaning inlet, and a second flexible hose fluidly connecting the second base outlet to the second rigid pipe.

* * * * *